United States Patent [19]

Dubrulle et al.

[11] Patent Number: 4,977,723

[45] Date of Patent: Dec. 18, 1990

[54] PLANT FOR PACKING PRODUCTS IN CONTAINERS

[75] Inventors: Gérard Dubrulle, Elancourt; Alain Roullet, Villejuif, both of France

[73] Assignee: L'Air Liquide, Societe Anonyme Pour L'Etude et L'Exploitation des Procedes Georges Claude, Paris, France

[21] Appl. No.: 488,364

[22] Filed: Dec. 14, 1989

Related U.S. Application Data

[63] Continuation of Ser. No. 233,411, Aug. 17, 1988, abandoned.

[30] Foreign Application Priority Data

Aug. 17, 1987 [FR] France ..... 87 11636

[51] Int. Cl.[5] ..... B65B 31/02

[52] U.S. Cl. ..... 53/110; 53/510; 141/64; 141/85

[58] Field of Search ..... 53/86, 84, 85, 89, 90, 53/97, 110, 167, 431, 432, 510, 511, 512; 141/63, 64, 82, 85

[56] References Cited

U.S. PATENT DOCUMENTS

| | | | |
|---|---|---|---|
| 2,369,762 | 2/1945 | Stewart et al. | 53/110 |
| 2,763,107 | 9/1956 | Day et al. | 53/110 |
| 2,869,301 | 1/1959 | Stover | 53/110 |
| 2,962,060 | 11/1960 | Harmon et al. . | |
| 3,220,157 | 11/1965 | Buchner | 53/512 X |
| 3,670,786 | 6/1972 | Levin et al. | 53/110 X |
| 3,871,157 | 3/1975 | Domke et al. | 53/110 |
| 3,942,301 | 3/1976 | Domke | 53/510 X |
| 4,523,433 | 6/1985 | Takahashi et al. . | |
| 4,602,473 | 7/1986 | Hayashi et al. . | |

FOREIGN PATENT DOCUMENTS

| | | | |
|---|---|---|---|
| 0092966 | 11/1983 | European Pat. Off. . | |
| 0197732 | 10/1986 | European Pat. Off. . | |
| 3323710 | 1/1985 | Fed. Rep. of Germany | 53/431 |
| 2089191 | 6/1981 | United Kingdom | 53/431 |

*Primary Examiner*—Robert L. Spruill
*Assistant Examiner*—Beth Bianca
*Attorney, Agent, or Firm*—Young & Thompson

[57] ABSTRACT

The plant comprises a conveyor (1) above which are disposed a device (3) for injecting liquefied gas into the containers and, on the downstream side of the device relative to the direction of travel of the conveyor, a device (4) for closing the containers, and a tunnel (5) for protecting the containers against the surrounding air and extending between the injecting device (3) and the closing device (4). Application in the packing of non-gaseous beverages and organic products in cans or bottles.

7 Claims, 1 Drawing Sheet

PLANT FOR PACKING PRODUCTS IN CONTAINERS

This application is a continuation of application Ser. No. 233,411, filed Aug. 17, 1988, now abandoned.

The present invention relates to a plant for packing products in containers, of the type comprising a conveyor on which are disposed a device for injecting liquefied gas into the containers, and, downstream of the device relative to the direction of movement of the conveyor, a device for closing the containers.

When packing in containers, such as cans or bottles, various products which may be in particular liquid or pasty, in very varied fields (food, phyto-medical, chemical, pesticide and fungicide products, etc.) either one or both of the following problems are posed:

protection by rendering the capped product inert with respect to the surrounding air and essentially with respect to oxygen;

maintenance, or production, of a predetermined overpressure before placing the stopper of the container in position.

Protection against oxygen may be necessary for various reasons including the risk of deterioration of the product by the oxygen of the air, possible attack of the product by a product of this reaction, depressurization (or a rising pressure) of the case (which is more or less flexible) of the container as a result of reactions of the product with oxygen (for example in the case of products containing terpenes). This modification in the pressure deforms the packing and results in problems concerning storage (for example bulging bottles), aesthetic appearance or adherence of the subsequently applied labels.

The pressurization of the containers permits compensating for the depressurization of the containers when the products packed in the warm state cool down, and/or compensating for the permeation of gases through the wall of the containers, and it improves the strength of the containers when handling while permitting a reduction in the thickness of the wall used in their construction.

Two methods are at present employed for these purposes rendering the product inert by means of gas: the containers pass through a tunnel or hooded passage with or without a lock chamber, under a maintained gaseous pressure, or under devices (pipes, tubes, nozzles . . . ) which inject the considered gas. The gas employed is usually nitrogen, carbon dioxide, or even a mixture thereof. Rather low residual oxygen contents may be in this way obtained (up to about 3% in some cases), but a high overpressure cannot be produced or maintained;

rendering the product inert/pressurized by means of a liquid: the containers receive, before the stopper is placed in position, a few drops of a liquefied gas which vaporizes, expels the air and creates the desired overpressure. The corresponding plants, which are of the type indicated hereinbefore (see for example the patent EP 103 506), often produce unstable final pressures which are a function of the quality of the calefaction and of the type of product being treated, in particular its proportion of aqueous phase; moreover, the oxygen content rapidly rises after the partial evaporation of the liquefied gas; lastly, as the consumption of liquefied gas is low, the degassing and the loss of gaseous nitrogen during storage are proportionately large.

An object of the present invention is to provide a plant which is capable of producing and maintaining a constant and adjustable overpressure and a very low content of residual oxygen, irrespective of the type of product packed.

For this purpose, the invention provides a plant of the aforementioned type, comprising a device for protecting the containers against surrounding air and extending between the injecting device and the closing device.

In a preferred embodiment, the protecting device constitutes a tunnel covering the conveyor and the plant comprises means for injecting said gas in the gaseous state into the tunnel. The protecting device may in particular comprise, at least in a part of the length thereof, a flexible upper wall located at a short distance from the opening of the containers.

An embodiment of the invention will now be described with reference to the accompanying drawings, in which.

Figure 1:
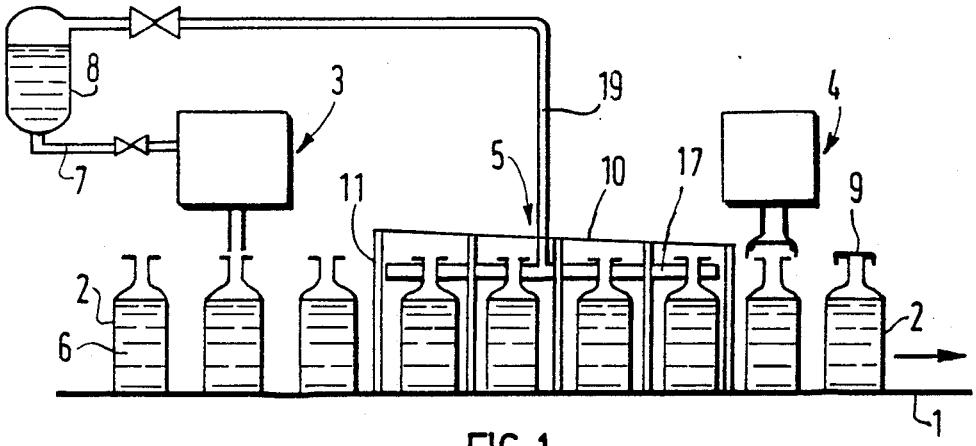
FIG. 1 is a diagrammatic elevational view, partly in section, of a packing plant according to the invention.
Figure 2:
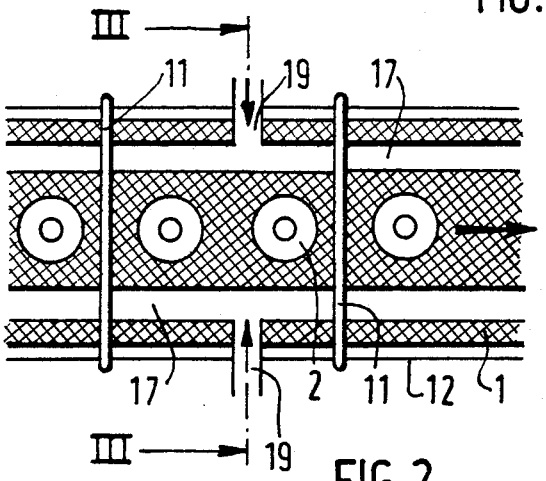
FIG. 2 is a diagrammatic top plan view of the interior of the protecting tunnel, the wall of the latter having been removed.
Figure 3:
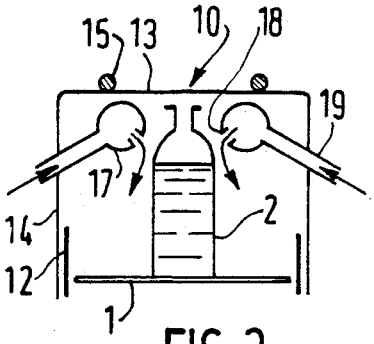
FIG. 3 is a sectional view taken on line III—III of FIG. 2.
Figure 4:
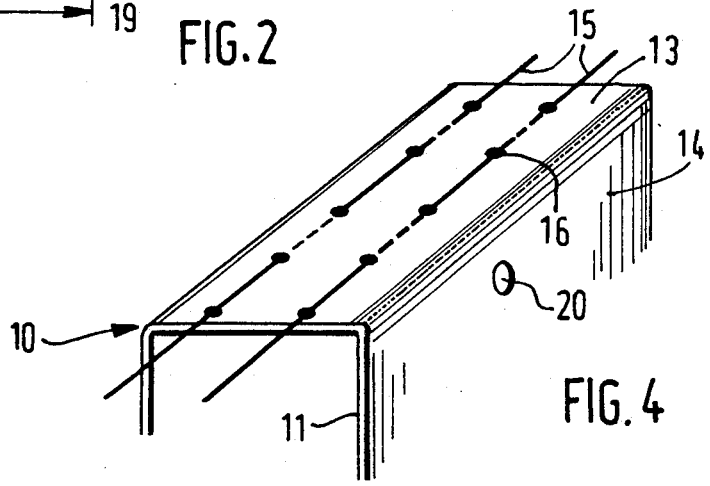
FIG. 4 is a diagrammatic perspective view of the protecting tunnel.

The packing plant shown in FIGS. 1–3 mainly comprises a conveyor 1 on which are conveyed containers 2 disposed in a single line, a liquid nitrogen injecting device 3, a device 4 for closing the containers, and a protecting tunnel 5. The devices 3 and 4 are located in vertical alignment with the conveyor, the device 4 being placed on the downstream side of the device 3 relative to the direction of travel of this conveyor; the tunnel 5 covers the conveyor between these two devices from a place located slightly downstream of the device 3 to a place slightly upstream of the device 4.

Thus, the containers 2, which are bottles of plastics material in the presently-described embodiment, after having received a given quantity of product 6, which may be in particular an organic liquid, travel in succession under the device 3, through the tunnel 5 and then under the device 4. The liquid nitrogen injecting device 3 may be any one of the various known types of devices, for example that described in the aforementioned patent EP 103 506. It is supplied with liquid nitrogen through a thermally insulated pipe connected to the lower part of a liquid nitrogen tank 8.

The closing device 4 is also conventional. It secures a stopper 9 on each bottle leaving the tunnel 5 by a forming-over operation.

The tunnel 5, which is open at both ends, has a flexible wall 10 formed by a material resisting low temperatures, for example a sheet of "Mylar", supported by a series of hoops 11 secured to the fixed sides 12 (FIGS. 2 and 3) alongside the conveyor 1. These hoops impart to the wall 10 a roughly constant cross-sectional shape, for example rectangular as shown in FIG. 3, with an upper wall 13 and two side walls 14 which are also secured to the sides 12. Further, two cables 15 passed through longitudinal rows of openings 16 provided in the upper wall 13, include means (not shown) for putting under tension and preventing the sagging of this wall 13 between the hoops 11. When seen in side elevation (FIG. 1), the wall 13 slopes slightly downwardly in the downstream direction.

Two longitudinal distributors 17 are mounted in the tunnel 5 on each side of the bottles 2 and extend throughout the length of the tunnel. Each distributor defines a longitudinal slot 18 located at roughly two thirds of the height of the bottles 2 and downwardly oriented at about 45°. Each distributor is supplied with liquid nitrogen through a pipe 19 connected to the top of the gaseous nitrogen tank 8 and extending through an opening 20 in the corresponding side wall 14.

The plant just described operates in the following manner.

As it passes under the device 3, each bottle receives directly on the product 6 a small given quantity of liquid nitrogen. This liquid gradually vaporizes as the bottle travels through the tunnel 5 and produces gaseous nitrogen which expels the air contained in the upper part of the bottle. In order to accelerate this vaporization, in particular when the product 6 is an organic liquid which does not freeze under the effect of this small amount of liquid nitrogen, the bottles 2 are subjected to shocks or vibrations in the tunnel 5 by known means (not shown) so as to break into multiple droplets the single drop of liquid nitrogen which is formed on the product 6 under the effect of the calefaction.

The tunnel 5 has for purpose to prevent the backward diffusion of the air into the bottles. To this end, the upper wall 13 limits the section of the passage of the gases around the necks of the bottle and increases the exit velocity of the gases from these necks, and the distributors 17 continuously inject gaseous nitrogen into the tunnel, this gaseous nitrogen passing downwardly and licking the bottles as shown in FIG. 3.

The length of the tunnel is so chosen that the end of the vaporization of the liquid nitrogen occurs slightly upstream of the outlet of the tunnel. Bearing in mind the resulting decrease in the volume of gaseous nitrogen during this vaporization, the downwardly inclined shape of the wall 13 produces a roughly constant overpressure in the bottles 2 throughout the length of the tunnel, at least in the end part of the latter.

As they leave the tunnel 5, the upper part of the bottles consequently contain gaseous nitrogen under a slight overpressure which maintains an ascending current of nitrogen during a brief lapse of time, on the order of a second, between the exit of a bottle from the tunnel and the moment it is provided with a stopper by the device 4.

It is in this way possible to obtain bottles containing an organic product with a gaseous atmosphere above the product constituted by nitrogen containing a substantially constant residual oxygen content of 3–4% with an overpressure which is roughly uniform from one bottle to the other and on the order of 50 to 100 mb. Rendering the interior of the tunnel inert by means of the distributors 17 moreover permits the use of nitrogen vapours formed in the tank 8 under the effect of entry of natural heat and consequently results in no, or almost no, additional consumption of nitrogen.

The invention is applicable to the packing of very diverse products and in particular liquid or pasty products, such as: non-gaseous beverages, pesticides, fungicides, phyto-medical products or liquid detergents, solvents and chemical or petroleum, cosmetic and pharmaceutical products, etc. The containers may be bottles, cans, etc. and may be made from glass, metal, or plastics material, etc.

We claim:

1. A plant for packing products in containers each having a top opening, said plant comprising a conveyor, a device for injecting liquefied gas into the containers and placed above the conveyor such that upon vaporization of said liquefied gas, air is removed from the containers by a flow of vaporized gas, a device for closing the containers and placed above the conveyor and on the downstream side of the injecting device relative to a direction of travel of the conveyor, and a tunnel for protecting the containers against surrounding air, said tunnel covering the conveyor and extending between the injecting device and the closing device, said tunnel comprising, in at least a pat of the length thereof, an upper wall located at a distance from the openings of the containers which is short enough to limit the section of the passage of gas out of the containers and to increase the exit velocity of said gas from said containers, said tunnel further comprising means for injecting said gas in a gaseous state into the tunnel while said containers are open, and means positioning said gas injecting means so that said gas is directed solely toward the sides of said containers below said top openings along at lest said part of the tunnel to prevent the backward diffusion of air into the containers.

2. A plant according to claim 1, wherein said upper wall slopes downwardly relative to the tops of the containers in the downstream direction of travel of the conveyor.

3. A plant according to claim 1, wherein said upper wall is made of a flexible non-self-supporting material, supported by structural members.

4. A plant according to claim 3, wherein two side sheets extend said upper wall and are fixed on each side of the conveyor, and said structural members comprise means on said upper wall for adjusting the tension of said upper wall.

5. A plant according to claim 1, comprising a liquefied gas storage tank, a liquefied gas supply pipe connecting a lower part of the tank to the injection device, and a pipe for supplying said gas injecting means with vaporized gas leading from an upper part of the tank.

6. A plant according to claim 5, wherein said gas injecting means comprise two injecting distributors extending along edges of the tunnel, the vaporized gas supply pipe being connected to said distributors.

7. A plant according to claim 6, wherein the injecting distributors are located at a level of an upper part of the containers and define gas injecting openings which are obliquely downwardly oriented in a direction toward the containers.

* * * * *